US007510049B2

(12) United States Patent
Kling

(10) Patent No.: US 7,510,049 B2
(45) Date of Patent: Mar. 31, 2009

(54) ACOUSTIC TRANSFORMER AND METHOD FOR TRANSFORMING SOUND WAVES

(75) Inventor: Martin Kling, Junkersstrasse 14, 30179 Hannover (DE)

(73) Assignees: Martin Kling, Hannover (DE); Jurgen Freitag, Hannover (DE)

( * ) Notice: Subject to any disclaimer, the term of this patent is extended or adjusted under 35 U.S.C. 154(b) by 118 days.

(21) Appl. No.: 11/585,573

(22) Filed: Oct. 24, 2006

(65) Prior Publication Data

US 2008/0006476 A1 Jan. 10, 2008

(30) Foreign Application Priority Data

Oct. 27, 2005 (DE) ..... 10 2005 051 809

(51) Int. Cl.
*G10K 11/02* (2006.01)
*H04R 1/20* (2006.01)
*G10K 11/00* (2006.01)

(52) U.S. Cl. ..... 181/187; 181/185; 381/339; 381/343

(58) Field of Classification Search ..... 181/187, 181/188, 189, 185; 381/339, 340, 343
See application file for complete search history.

(56) References Cited

U.S. PATENT DOCUMENTS 1,849,840 A * 3/1932 Kellogg ..... 181/187
2,537,141 A * 1/1951 Klipsch ..... 181/187
4,091,891 A 5/1978 Hino et al.
4,390,078 A * 6/1983 Howze et al. ..... 181/185
4,685,532 A * 8/1987 Gunness ..... 181/185
5,163,167 A 11/1992 Heil
5,631,450 A * 5/1997 Itakura ..... 181/189
5,675,133 A * 10/1997 Kobayashi ..... 181/189
6,059,069 A * 5/2000 Hughes, II ..... 181/152
6,343,133 B1 * 1/2002 Adamson ..... 381/340

(Continued)

FOREIGN PATENT DOCUMENTS

DE 689 15 582 1/1995

*Primary Examiner*—Edgardo San Martin
(74) *Attorney, Agent, or Firm*—Jordan and Hamburg LLP

(57) ABSTRACT

An acoustic transformer for transforming sound waves generated by, for example, a round membrane, into a rectangular wave front with reduced interfering resonances is provided in a form of a waveguide with a generally circular entrance and a generally rectangular exit defined by outer walls. The sound waves, arriving from the radiating membrane, are divided geometrically into two flows of sound waves of generally semicircular cross section. Each of the two flows of sound waves is deformed individually into a rectangular shape. Subsequently, the flows of sound waves are brought together once again at an acute angle. The division of the sound flow of circular cross section into two sound flows of semicircular cross section creates two sound flows, which already have a straight side surface. The two sound flows are passed into curved sound guides, which initially have a generally semicircular cross section and then gradually change over into a generally rectangular cross section. A displacement structure which is approximately elliptical in cross section, thickens gradually and, after reaching a maximum, falls off once again, is disposed to protrude inward of the approximately straight and flat wall of each of the sound guides. Each of the displacement structures along with a corresponding one of the outer walls provides a sound channel, which initially is semicircular in cross section, with a bent cross section of uniform thickness and then stretches into a rectangular cross section at an end thereof.

10 Claims, 2 Drawing Sheets

U.S. PATENT DOCUMENTS 6,394,223 B1 * 5/2002 Lehman ..... 181/152
7,044,265 B2 * 5/2006 Murphy ..... 181/192
2004/0216948 A1 * 11/2004 Meyer et al. ..... 181/188

* cited by examiner

ACOUSTIC TRANSFORMER AND METHOD FOR TRANSFORMING SOUND WAVES

BACKGROUND OF THE INVENTION

The invention relates to an acoustic transformer in the form of a waveguide with a generally circular entrance and rectangular exit, and which includes a fixed wall which, is in the center of the transformer, extends from one side to the other, divides the transformer into two parts of substantially equal size and divides the transformer into two waveguides of substantially identical shape and which have a cross sectional shape, which is initially in the shape of a semicircle and then changes over into the shape of a rectangle. The invention relates further to a method for transforming sound waves radiated by a circular or oval membrane into a rectangularly radiating surface.

Transforming is understood in the present context to be the conversion of a circular sound wave front into a broader rectangular sound wave of identical phase and amplitude, and a transformer is understood herein to be a waveguide which carries out this conversion.

For certain purposes, rectangular sound-radiating surfaces are required in electroacoustic sound radiation. Since electroacoustic generation of sound succeeds best with circular or oval membranes, an acoustic transformer, which previously was realized by different waveguides of different construction, is required to transform sound waves, which are radiated by a circular or oval membrane, into a rectangularly radiating surface.

Such an acoustic transformer is previously known from DE 689 15 582.4. A waveguide is described with a bulbous housing with a circular inlet for the sound waves and a rectangular outlet, in which there is a freely suspended body, which, on the inlet side, is formed as a cone having the width of the rectangular outlet slot and changes over on the outlet side into two flat surfaces, which extend at an angle to one another and to the rectangular exit. With the housing, enveloping this body, this waveguide, in the passing-through direction as well as in the circumferential direction, forms an uninterrupted passage for the sound waves, in which the latter pass over a path of equal length from the circular entrance to the rectangular exit. At the same time, the path for the sound waves initially forms an exact conical surface spreading the sound waves apart, and then an annular channel, which leads the sound waves together into a rectangular shape.

Measurements at the rectangular outlet of the above-described acoustic transformer have shown that the latter has resonances for certain frequencies, which is highly undesirable for the transmission of sound and music performances.

The horns of musical instruments and automobiles are other types of acoustic transformers. These also have a curved sound path, which expands in diameter and sometimes has an oval exit, but do not have any sound-dividing internal parts, nor the sound-radiating rectangular surface at the exit. They serve to amplify and concentrate the sound.

A special shape of horn loudspeaker is also disclosed in U.S. Pat. No. 4,091,891, having a partition which is disposed centrally in the horn and terminates in material thickenings at its sides. By these means, two mutually adjacent horns are created, which are to bring about an improved funnel-shaped radiation of low, as well as middle, frequencies.

An object of the invention is therefore to avoid the disadvantages of the prior art.

It is a further object of the invention to provide an acoustic transformer without pronounced resonances, which undertakes the transformation over the whole of the exit in phase and at the same amplitude.

SUMMARY OF THE INVENTION

In accordance with these and other objects of the invention, a dividing wall, dividing a transformer into two waveguides of substantially identical shape, extends from a generally circular entrance to a generally rectangular exit. The dividing wall itself comprises, or carries thereon, displacement bodies (or structures) with curved surfaces, for example surfaces of a spherical or elliptical cap, and outer walls of the waveguides extend essentially parallel to the surface of the displacement bodies (structures). The ends of the waveguides run out at an acute angle toward one another.

The radiation from this transformer is not funnel-shaped, but rather, essentially straight ahead, as from a directional radiator.

The division of the sound flow of circular cross section into two sound flows of semicircular cross section creates two sound flows, which already have a straight side surface. The two sound flows are guided in waveguides, which are curved in the direction of the sound flow. The waveguides initially have a semicircular cross section, then, spreading out the sound flows guided in them, change over into a cross section curved transversely to the direction of the sound flow, and finally are converted gradually into a rectangular cross section.

The inventive acoustic transformer is configured so that the generally circular entrance is divided into two parts of substantially equal size by at least one solid dividing wall extending from one side of the sound guide to the other. At the entrance so divided, two waveguides of substantially identical shape adjoin, which initially have the cross-sectional shape (transversely to the flow of the sound) of a semicircle, are curved in opposite directions in the flow direction of the sound, and initially provide the sound flow with a cross section (curved transversely to the direction of the flow of the sound) and subsequently spread it out into a rectangular shape transversely to the flow direction of the sound. At their ends, the waveguides run out towards one another at an acute angle.

Comparatively, this acoustic transformer has only slight resonances, which are by no means pronounced. It can be manufactured without problems. When produced in large numbers, the two horn-like waveguides of simple shape reduce the manufacturing costs.

Moreover, for reducing production costs, it is advisable that each waveguide has a wall, which is bent from a flat sheet (or strip) of metal, to form the continuation of the wall dividing the entrance into semicircles, and extends from the entrance to the exit.

This acoustic transformer can be produced even more economically if the two dividing walls are flat and carry a displacement body on their flat sides facing the flow of sound, the outer walls of these waveguides extending essentially parallel to the surface of the displacement bodies, and this acoustic transformer being assembled from two equally formed sound channels, the flat wall surfaces of which are placed on top of one another.

Moreover, if the sound waves after transformation spread very wide, it may be appropriate that the distance between the displacement body (or other displacement structure) and the outer wall is smallest in the approximate center of the waveguide.

The production becomes particularly simple and economical if, instead of the straight and flat, mutually adjoining walls, the two waveguides have only one common flat dividing wall, which extends from the entrance of the transformer up to its exit and which is covered on either side with a displacement body. This means that the dividing wall, dividing the sound flow of circular cross section into two flows of semicircular cross section, is flat and extends from the entrance of the transformer up to its end and goes over seamlessly into the side walls of the transformer housing.

Advisably, the displacement body has the shape of a spherical or ellipsoidal cap. Such a displacement body can be produced in very simple molds from plastic, such as a foamed plastic.

Advisably, the outer wall of this sound guide is adapted to the shape of the sound flow and changes over from an approximate tulip shape behind the entrance to a generally rectangular shape at the exit.

A molded object, which is approximately ellipsoidal in cross section, gradually thickens and, after reaching a maximum, falls off again flat, is placed on the straight and flat wall of this sound guide. This molded object in part provides the sound channel, which initially is semicircular in cross section, with a bent cross section, which is uniform in thickness, and then stretches at its end into a rectangular cross-section.

The above, and other objects, features and advantages of the present invention will become apparent from the following description read in conjunction with the accompanying drawings.

DETAILED DESCRIPTION OF THE PREFERRED EMBODIMENT

Figure 1:
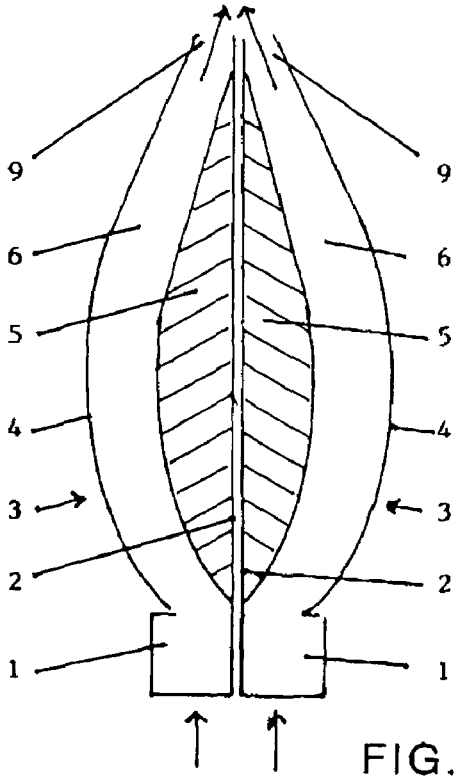
FIG. 1 is a cross-sectional view through the acoustic transformer in the direction of the flow of the sound.
Figure 5:
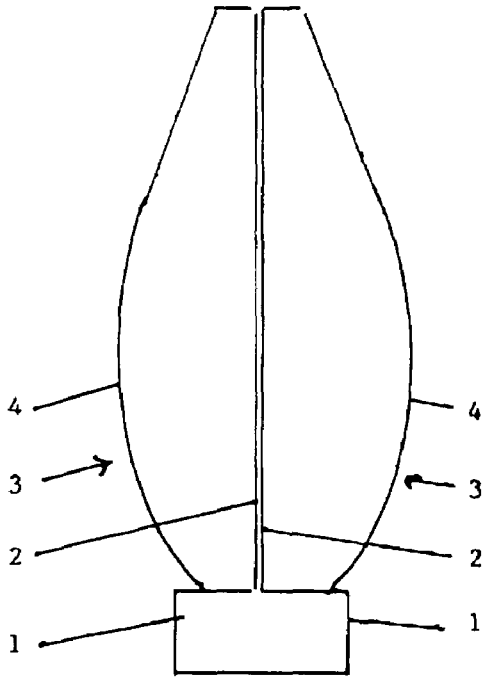
FIG. 5 is a view of the narrow side of the acoustic transformer.
Figure 2:
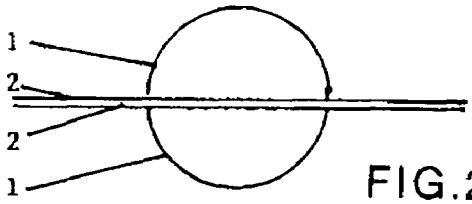
FIG. 2 is a cross-sectional view through the acoustic transformer transversely to the direction of flow of the sound at the entrance.
Figure 3:
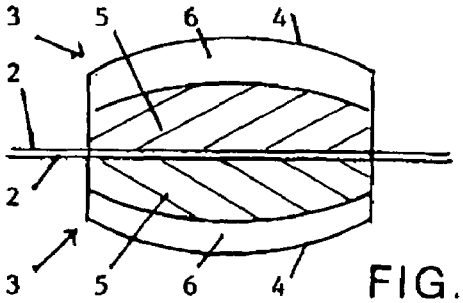
FIG. 3 is a cross-sectional view through the acoustic transformer transversely to the direction of flow of the sound in its center.
Figure 4:
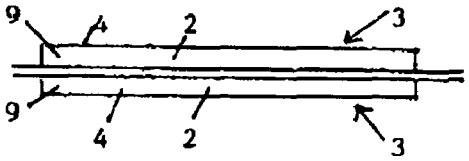
FIG. 4 is a cross-sectional view through the acoustic transformer transversely to the direction of flow of the sound at its exit.

Referring now to FIGS. 1-6, an acoustic transformer according to an embodiment of the invention is depicted in the various views. In accordance with the embodiment, a generally circular entrance 1 for sound waves is divided in an approximate middle thereof by two dividing walls 2. A pair of waveguides 3 defines a sound path 6 through which the sound waves travel in a direction of the arrows shown in FIG. 1, each of the waveguides 3 being comprised of a corresponding one of the dividing walls 2, a curved outer wall 4, and a displacement body 5 fastened to the inside of each of the corresponding walls 2. The waveguides 3 extend from the generally circular entrance 1 to a generally rectangular exit 9, provided, for example, in the form of a slot, as shown in FIG. 4. The displacement body 5 lengthens the sound path 6 traversed by the sound waves centrally between the entrance 1 to the exit 9. The outer walls 4 of the two waveguides 3 are fastened to dividing walls 2, as shown in FIG. 5, thereby enclosing the sound paths 6.

Figure 10:
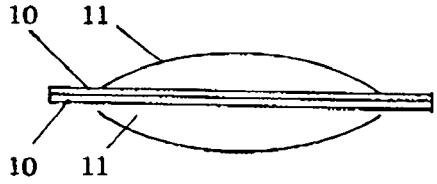
FIG. 10 is a side view of the pair of sheet members of FIGS. 7 and 8 after assembly.

Turning now to FIGS. 7-10, in accordance with another embodiment, rather than providing sound waves displacing structure in the form of discrete displacement bodies 4 carried on the dividing walls 2, a surface configuration of a sheet comprising each of the dividing walls serves instead as sound waves displacing structure. As shown in FIGS. 7-10, a sheet member comprised of suitable sheet material, for example, sheet metal, includes a peripheral structural portion serving as a dividing wall 10 and a region (created by pressing or other suitable forming process) defining a sound waves displacement portion 11 which is extended (bulged) from a plane of the peripheral structural portion serving as the dividing walls 10. When mutually attached, as shown in FIG. 10, the dividing walls 10 and the sound waves displacement portions 11 provide an effect analogous to the corresponding structure of the displacement bodies 5 carried on the dividing walls 2 of the previous embodiment.

Figure 11:
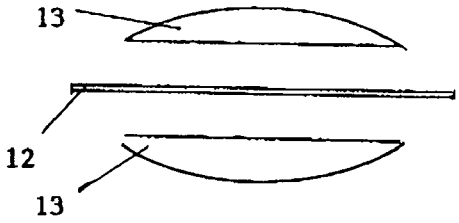
FIG. 11 is a side view of another embodiment wherein a pair of individual bodies which serve as sound waves displacing bodies are received to a single dividing wall of sheet material on opposed sides thereof.
Figure 12:
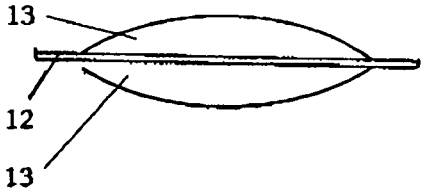
FIG. 12 is a side view of the embodiment of FIG. 12 after assembly of the individual bodies to the dividing wall.

In another embodiment, which is shown in FIGS. 11 and 12, the two centrally disposed walls 2 of the previous embodiments is replaced by a single wall 12, which carries, on either side thereof, displacement bodies 13, formed of plastic or other suitable material by molding, machining, etc. While not depicted in FIGS. 11 and 12, the outer wall 4 is attached to the single wall 12 in a like manner to that described in connection with the pair of walls 2 in the embodiments shown in FIGS. 1-6.

Figure 6:
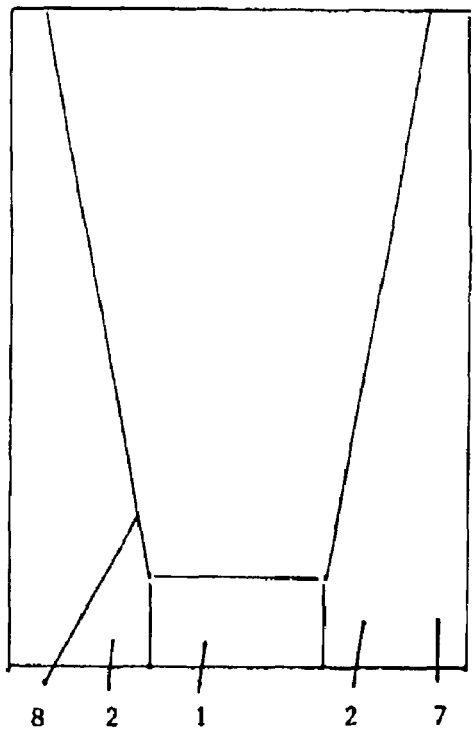
FIG. 6 is a view of the wide side of the acoustic transformer.
Figure 7:
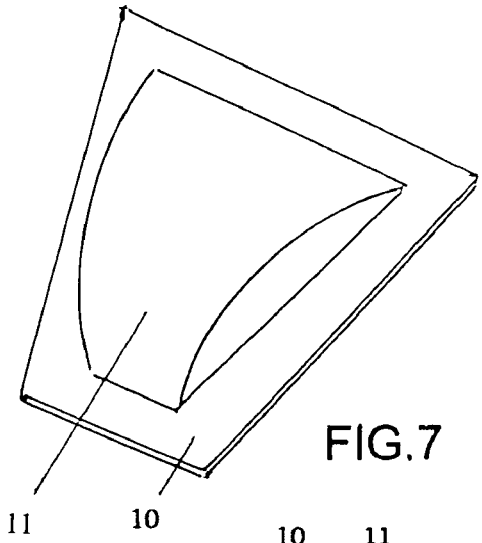
FIG. 7 is an top perspective view of an embodiment in which a sheet member includes a structural portion serving as a dividing wall and a region defining a sound waves displacement structure.
Figure 8:
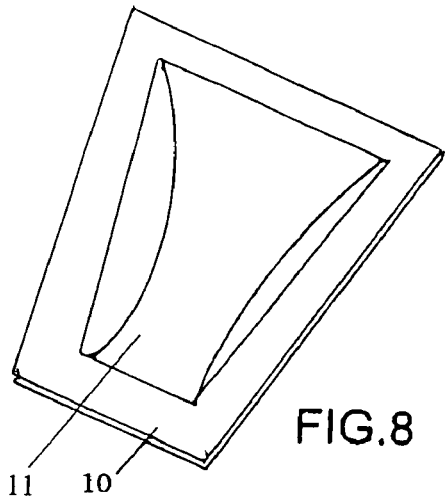
FIG. 8 is a bottom perspective view of the sheet member of FIG. 7.
Figure 9:
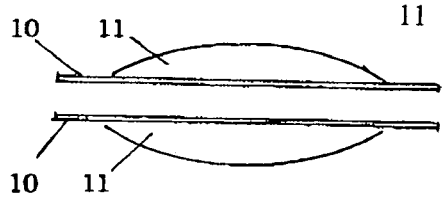
FIG. 9 is a side view of a pair of sheet members of FIGS. 7 and 8 prior to assembly, one to the other.

Advantageously, the dividing walls 2 (or alternatively, the single dividing wall 12, in analogous fashion), described above, protrude beyond the outer edges 8 of the outer walls 4, as shown, for example, in FIG. 6. These protruding parts (part) can then serve as a holding device 7 for the waveguide 3.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An acoustic transformer, comprising:

outer walls defining an outer envelope;

at least one dividing wall being disposed centrally of the outer walls and extending from one side of the outer envelope to another side of the outer envelope, said at least one dividing wall dividing the outer envelope into two parts defining, along with said outer walls, two waveguides of substantially identical shape, each of said two waveguides including a generally circular entrance at a first end and a generally rectangular exit at a second end and having a cross sectional shape which is initially generally semicircular proximate to the entrance and which then changes over into a generally rectangular shape proximate to the exit, said dividing wall extending from the entrance to the exit; and sound waves displacement structures, each presenting a convexly curved surface, extending into each of the two waveguides from said at least one dividing wall, each of the outer walls of the waveguides being disposed approximately parallel to the surface of a corresponding one of the displacement structures, respective ends of the waveguides running out at an acute angle toward one another.

2. The acoustic transformer according to claim 1, wherein each of the two waveguides is bounded by a wall comprised of a flat sheet material which divides the generally circular entrance into the two semicircles and which extends from the entrance to the exit.

3. The acoustic transformer according to claim 1, wherein that the flat wall of each of the two waveguides carries a displacement body on a flat surface thereof facing the sound flow, the displacement body carried on each flat wall defining said displacement structures.

4. The acoustic transformer according to claim 1, wherein a distance of each of the displacement structures from a corresponding one of the outer walls is smallest in an approximate center of the waveguide.

5. The acoustic transformer according to claim 1, wherein the two waveguides have a single common dividing wall carrying a displacement body on either side thereof collectively defining said displacement structures.

6. The acoustic transformer according to claim 1, wherein the at least one dividing wall, dividing a flow of sound of generally circular cross section into two flows of generally semicircular cross section, is essentially flat and extends from the entrance of the transformer to the exit thereof, and changes over seamlessly into side walls of a transformer housing.

7. The acoustic transformer according to claim 1, wherein flat outer wall surfaces of two substantially identically shaped sound channels are placed on top of one another.

8. The acoustic transformer according to claim 2, wherein flat outer wall surfaces of two substantially identically shaped sound channels are placed on top of one another.

9. The acoustic transformer according to claim 1, wherein a cross-section of each of said displacement structures transverse to a flow of sound is convex, the flow of sound being from the first end to the second end of each of said waveguides.

10. The acoustic transformer according to claim 1, wherein the outer walls converge at the second end of the wave guides, whereby a flow of sound from each of the waveguides converges at an acute angle at the second end.

* * * * *